US007048676B1

(12) United States Patent
Wu

(10) Patent No.: US 7,048,676 B1
(45) Date of Patent: May 23, 2006

(54) METHOD OF CONTROLLING RUNNING STATUS OF TREADMILL

(75) Inventor: Shen Yi Wu, Wu Feng Township, Taichung County (TW)

(73) Assignee: Strength Master Health Corp., Taichung (TW)

( * ) Notice: Subject to any disclaimer, the term of this patent is extended or adjusted under 35 U.S.C. 154(b) by 0 days.

(21) Appl. No.: 11/032,129

(22) Filed: Jan. 11, 2005

(51) Int. Cl.
*A63B 22/00* (2006.01)

(52) U.S. Cl. ..... 482/54; 482/51

(58) Field of Classification Search ..... 482/1–9, 482/900–902, 51, 54
See application file for complete search history.

(56) References Cited

U.S. PATENT DOCUMENTS 6,416,444 B1 * 7/2002 Lim et al. ..... 482/54
6,443,875 B1 * 9/2002 Golen et al. ..... 482/54
6,783,482 B1 * 8/2004 Oglesby et al. ..... 482/54

* cited by examiner

*Primary Examiner*—Glenn E. Richman
(74) *Attorney, Agent, or Firm*—Rosenberg, Klein & Lee

(57) ABSTRACT

A method of the present invention provides a sensor detecting a motor whether it is an idle running condition or a loading running condition. The idle running condition indicates that nobody on the treadmill, so that the motor keeps a designated running. If the motor is in the loading running condition, it has to be determined whether it is in continuous loading condition or an intermittent loading condition. The intermittent loading condition indicates that user is running on the treadmill, so that the motor keeps a designated running. The continuous loading condition indicates that user has stopped running but still standing on the treadmill or the belt is jammed, so that the motor is shut. The method of the present invention provides the treadmill to be shown and safety stopped.

3 Claims, 2 Drawing Sheets

METHOD OF CONTROLLING RUNNING STATUS OF TREADMILL

BACKGROUND OF THE INVENTION

1. Field of the Invention

The present invention relates generally to a treadmill, and more particularly to a method of controlling the running status of a treadmill.

2. Description of the Related Art

A conventional electrical treadmill has a motor to drive a belt, on which user can run. User also can adjust the speed of the belt by controlling the motor, such that user can choose a suitable condition to exercise on the treadmill.

For the safety of user, the conventional electrical treadmill is provided with a safety apparatus to detect the speed of motor. While the speed of the motor is lower to a predetermined value, which indicate that the belt may be jammed, the safety apparatus will stop the motor automatically for safety of user.

In case of a heavier user running on the belt of the treadmill in a lower running speed, and at the moment of the user stepping on the belt, the speed of the motor is lowered because of the suddenly greater loading. At this condition, the safety apparatus may be false alarm and stop the motor immediately to stop the exercise.

A feedback control system is provided to overcome the drawback described above.

The feedback control system has a sensor to detect the voltage and current of the motor and to control the speed of motor according to the voltage and current. For a example, in the case of a heavier user running on the belt of he/she running faster that increase the loading of the motor, the sensor will detect that and increases the voltage and current supplying to the motor to increase the speed or torque of the motor that would approach the speed of the belt to the actual condition. For an opposite condition, the safety apparatus decreased the voltage and current supplying to the motor to lower the speed or torque of the motor.

If the belt is jammed by extremities, a shoelace or clothes of user that increase the loading of the motor, the safety apparatus increases the voltage and current supplying to the motor after it detect that condition that would make the user in trouble to get out, and he/she might fell down and get injure in this condition. If the user get off the treadmill, the safety apparatus only detects the loading of the motor is lower and decreases the voltage and current supplying to the motor. In this condition, the belt keeps running but nobody on it. If the treadmill has not been turned off, and a child steps on it, the child would get injure.

In addition, if the treadmill is shown in an exhibition, and no one stands on the belt, the safety apparatus will restrict the belt running in a lower speed that might mistake the consumes that the treadmill only can run in a lower speed.

SUMMARY OF THE INVENTION

The primary objective of the present invention is to provide a method of controlling a running status of a treadmill, which provides a sensor detecting a motor whether it is an idle running condition or a loading running condition. The idle running condition indicates that nobody on the treadmill, so that the motor keeps a designated running. If the motor is in the loading running condition, it has to be determined whether it is in continuous loading condition or an intermittent loading condition. The intermittent loading condition indicates that user is running on the treadmill, so that the motor keeps a designated running. The continuous loading condition indicates that user has stopped running but still standing on the treadmill or the belt is jammed, so that the motor is shut. The method of the present invention provides the treadmill to be shown and safety stopped.

DETAILED DESCRIPTION OF THE INVENTION

Figure 1:
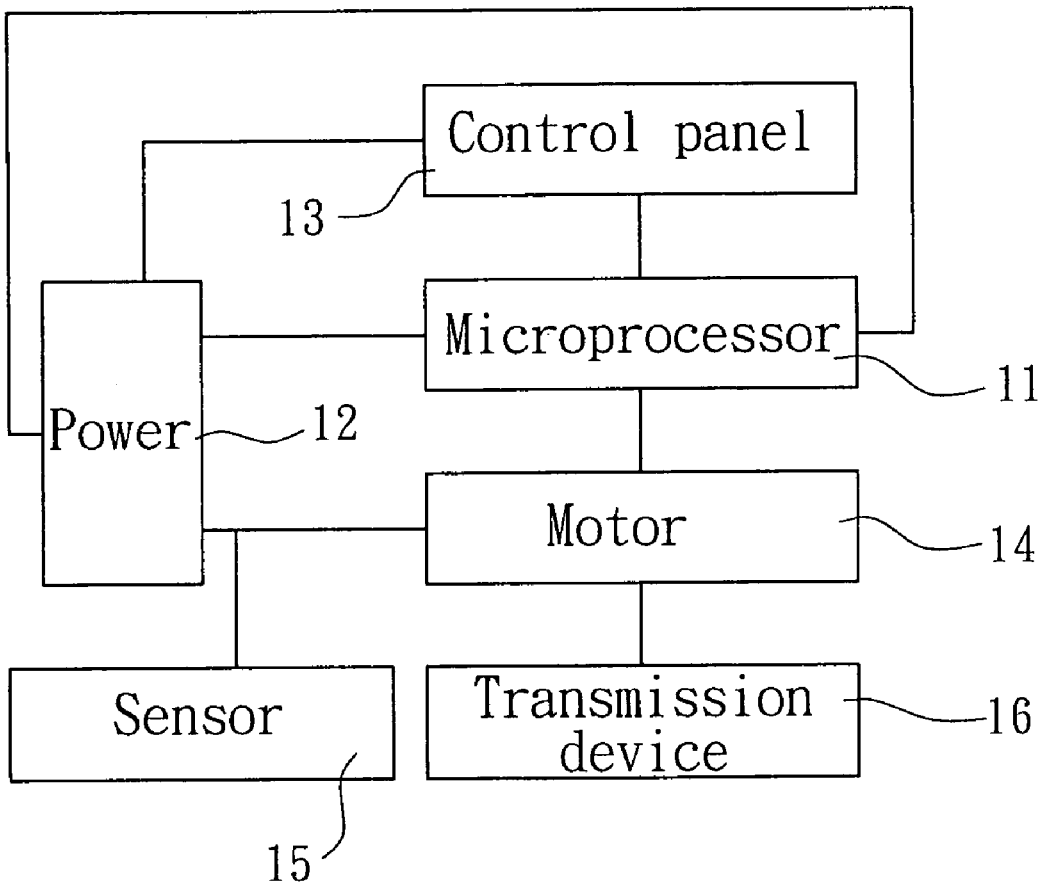
FIG. 1 is a block chart of the elements of a preferred embodiment of the present invention.
Figure 2:
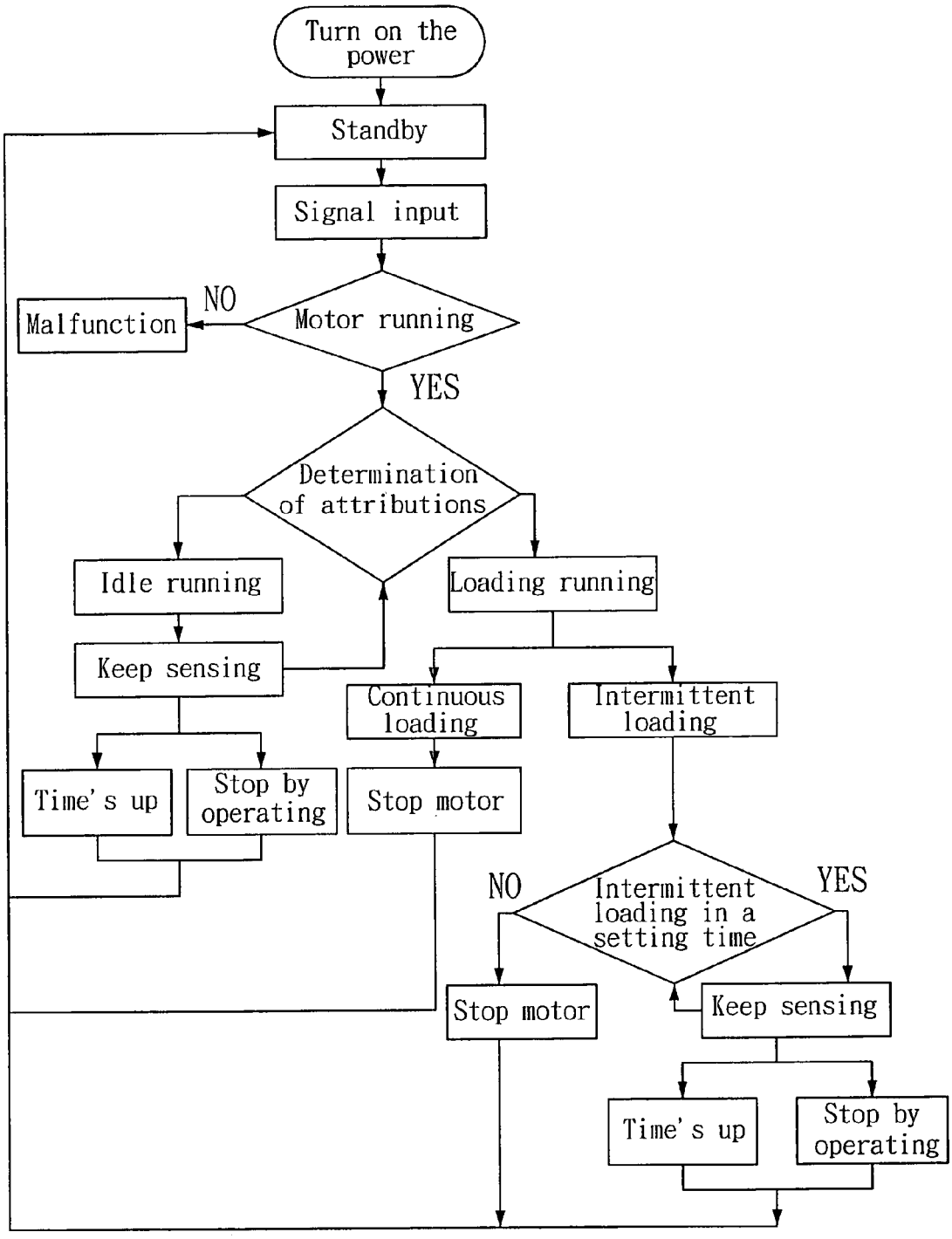
FIG. 2 is a flow chart of the preferred embodiment of the present invention.

As shown in FIG. 1 and FIG. 2, the FIGS. Only show a preferred embodiment of the present invention that does not restrict the scope of the present invention only.

A treadmill of the preferred embodiment of the present invention has a microprocessor 11, a power 12, a control panel 13, a motor 14 and at least a sensor 15. Signals can be feedback between the sensor 15 and the microprocessor 11. The control panel 13 is manipulative to input singles to control the motor 14 via the microprocessor 11. The motor 14 drives a belt (not shown) of the treadmill running via a transmission device 16. The sensor 15 detects an actual loading of the motor 14.

As shown in FIG. 2, a method of controlling the treadmill comprises the steps of:

Turning on the Power:

To operate the control panel 13 to turn on the power.

Standby:

The microprocessor 11, the motor 14 and the sensor 15 are tuned to standby conditions after the power is on.

Signal Input:

To input predetermined signals via the control panel 13.

Determination of a Running Status of the Motor:

The sensor 15 senses the motor for determination of the motor 14 running or not. If the motor 14 does not run, the microprocessor 11 makes a malfunction decision. If the motor runs, go to next step.

Determination of Attribution:

The sensor 15 detects the motor 14 whether it is an idle running condition or a loading running condition. The variation of the voltage and current of the motor 14 are detected by the sensor 15 to determine the motor 14 in the idle running condition or the loading running condition. If the motor 14 is in the idle running condition, the microprocessor 11 enters an idle running step; if the motor 14 is in the loading running condition, the microprocessor 11 enters a loading running step.

Idle Running Step:

The idle running indicates that nobody runs on the treadmill, and the sensor 15 keeps sensing the motor 14 for determination of attribution. If the motor 14 keeps in the idle running, the microprocessor turns the motor 14 off after a predetermined time. The motor 14 is turned to the standby condition when it is off. If the motor 14 is detected that it has a loading, which means a user stands and runs on it, the microprocessor 11 enters the loading running step.

Loading Running Step:

The motor 14 having loading indicates that a user stands and runs on it. The sensor 15 detects the motor 14 continuously, and the microprocessor 11 determines whether it is a continuous loading condition or an intermittent loading condition.

Continuous Loading Condition:

If the motor 14 is detected to be the continuous loading condition, which indicate that user stops running and stands on the belt or the belt is jammed by extremities, a shoelace or clothes of user, the microprocessor 11 shuts the motor 14 to avoid accident, and the motor is turned to the standby condition.

Intermittent Loading Condition:

The motor 14 is detected to be the intermittent loading condition that indicate that user is running or walking on the belt, and every steps provide loading to the motor 14, and the motor 14 is detected having loading intermittently and repeatedly. Such as, the motor 14 is detected having a loading, and the next loading is detected in a predetermined time (such as two second) after. In this condition, the sensor 15 detects the motor 14 continuously, and the microprocessor 11 controls the motor 14 for a designated running. Until the predetermined time is up, the microprocessor 11 shut the motor 14. The motor 14 is shut also when user operates the control panel 13 to stop the motor 14. If there is no another loading to the motor 14 in the predetermined time that indicate that there is nobody running or walking on the belt, the microprocessor 11 shuts the motor 14 and turns it to the standby condition.

The method of the present invention provides the sensor 15 to detect the running status of the motor 14 at initial to determine whether the motor 14 is in the idle running condition or in the loading running condition verify whether the treadmill is in use or it just put there for exhibition. If the treadmill is in the latter condition, the treadmill is taken care by people, and there is no safety issue, so that the microprocessor 11 controls the motor 14 running continuously according to the input signals to shows the performance of the treadmill until the time or the order is up.

If the treadmill is in the use condition, the sensor 15 and the microprocessor 11 determine whether the motor 14 is in the continuous loading condition or in the intermittent loading condition. If the motor 14 is determined in the intermittent loading condition that indicate someone is running on the treadmill, the microprocessor 11 controls the motor 14 running according to order until the time is up or the user stop it via the control panel 13.

If the motor 14 is determined in the continuous loading condition that indicates the user stops running or the belt is jammed, the microprocessor 11 shuts the motor. To compare with the conventional device, which the feedback control system increases the speed and torque of the motor while the motor is in the continuous loading condition, the present invention provides a safety condition in user.

If the motor is in the intermittent loading condition, and there is no further loading to the motor in the predetermined time that indicates user has left, the microprocessor 11 shuts the motor 14 to avoid accident.

In conclusion, the method of present invention not only identifies the shown condition and the actual use condition, but also automatically stops the treadmill when user leaves. The method of the present invention further can fully stop the treadmill when the belt is jammed to control the treadmill in both conditions of the shown condition and the actual use condition.

What is claimed is:

1. A method of controlling a treadmill running, which the treadmill has a microprocessor, a power, a control panel, a motor and at least a sensor, wherein signals are inputted from the control panel to order the microprocessor controlling the motor, and the motor drives a belt running via a transmission device, and the sensor senses an actual loading of the motor, comprising the step of:

turning on the power:

operating the control panel to turn on the power;

standby:

turning the microprocessor, the motor and the sensor to standby conditions respectively after the power is turned on;

single input:

inputting singles from the control panel;

determination of a running status of the motor:

the sensor detecting the motor to determining whether the motor is running or not, wherein if the motor 14 does not run, the microprocessor makes a malfunction decision, and if the motor runs, go to a following step of the present invention;

determination of attributions:

the sensor detecting the motor whether it is an idle running condition or a loading running condition, wherein if the motor is in the idle running condition, the microprocessor enters an idle running step, and if the motor is in the loading running condition, the microprocessor enters a loading running step;

the idle running step:

wherein the idle running indicates that nobody runs on the treadmill, and the sensor keeps sensing the motor for determination of the attributions, and if the motor keeps in the idle running, the microprocessor controls the motor running until a predetermined setting time is up or the control panel is operated to stop the motor, and then turns the motor to the standby condition after the motor has been stopped;

the loading running step:

wherein the motor 14 having loading indicates that a user stands and runs on the treadmill; the sensor detecting the motor continuously, and the microprocessor determining whether the motor is in a continuous loading condition or an intermittent loading condition;

the continuous loading condition:

wherein the motor in the continuous loading condition indicates that user stops running and stands on the belt or the belt is jammed; the microprocessor shutting the motor to avoid accident, and turning the motor to the standby condition;

the intermittent loading condition:

wherein the motor in the intermittent loading condition indicates that user is running or walking on the belt, and every steps provide the motor a loading respectively; the microprocessor and the sensor detecting the motor 14 having the loading intermittently and repeatedly in a predetermined time that indicates user is running on the treadmill, and the sensor keeping sensing the motor, and the microprocessor controlling the running until the predetermined time is up or the control panel is operated to stop the motor; wherein no loading to the motor in the predetermined time indicates that there is nobody running or walking on the treadmill; the microprocessor shutting the motor and turning the motor to the standby condition.

2. The method as defined in claim 1, wherein the sensor senses a variation of a current of the motor to determine whether the motor is in the idle running condition or the loading running condition.

3. The method as defined in claim 1, wherein the sensor senses a variation of a voltage of the motor to determine whether the motor is in the idle running condition or the loading running condition.

* * * * *